United States Patent [19]

Leighton

[11] Patent Number: 4,492,278

[45] Date of Patent: Jan. 8, 1985

[54] ROOF BIT

[75] Inventor: Joseph C. Leighton, Bridgeport, W. Va.

[73] Assignee: Hughes Tool Company, Houston, Tex.

[21] Appl. No.: 635,466

[22] Filed: Jul. 27, 1984

Related U.S. Application Data

[63] Continuation of Ser. No. 492,908, May 9, 1983, abandoned.

[51] Int. Cl.[3] ..... E21B 10/58

[52] U.S. Cl. ..... 175/410; 175/418

[58] Field of Search ..... 175/410, 411, 417, 418, 175/395, 419

[56] References Cited

U.S. PATENT DOCUMENTS

| | | | |
|---|---|---|---|
| 3,089,552 | 5/1963 | Black | 175/410 |
| 3,434,553 | 3/1969 | Weller | 175/410 |
| 3,434,554 | 3/1969 | Bower, Jr. | 175/410 |
| 4,313,506 | 2/1982 | O'Connell | 175/410 |

*Primary Examiner*—Stephen J. Novosad
*Assistant Examiner*—Michael Starinsky
*Attorney, Agent, or Firm*—Robert A. Felsman; Charles D. Gunter, Jr.

[57] ABSTRACT

A cutter bit wherein the dust collection openings are formed diametrically opposite each other, on an axis transverse to the longitudinal central axis of the bit body, and at least partly in the tapered dust control surfaces. The junctions of the heel surfaces and dust control surfaces define a pair of crown lines being parallel to one another and in planes which intersect the carbide insert in oblique fashion.

2 Claims, 5 Drawing Figures

ROOF BIT

This application is a continuation of application Ser. No. 492,908, filed May 9, 1983, now abandoned.

This application is related to the co-pending application of Joseph C. Leigerton, Ser. No. 409,229, filed Aug. 18, 1982, entitled "Roof Bit".

BACKGROUND OF THE INVENTION

1. Field of the Invention

This invention relates in general to drill bits and in particular to roof bits used to drill holes in mine roofs for the purpose of installing anchor bolts to support mine roofs during mining operations.

2. Description of the Prior Arts

In the early 1950's, the coal mining industry began to support mine roofs with an anchor bolting system, rather than by the former system of timbering. During installation of the anchor bolting system, one inch to one and one-half inch holes are drilled in the roof of the mine. Six-inch square plates are then bolted to the roof with roof bolts that extend upward through several layers of rock. The bolts and plates bind the strata together so that the bottom layers cannot collapse into the mine. Two different methods are used to secure the bolts in the drilled holes. One method is to use mechanical expansion and tensioning bolts, and the other method is to cement the bolts in place with a setting resin.

The holes for the bolts are generally drilled with a drilling system having a power source rotating a length of drill steel with a roof bit attached at the end. An example of such a drilling system is shown in U.S. Pat. No. 4,099,585. Early drills were light-weight and high-speed, with little upward thrust, but the power sources on more modern drills are usually around 75 horsepower and can generate up to approximately 10,000 pounds of thrust and 350 pounds torque. Rotation speeds are variable between 100 and 700 rpm, but approximately 500 rpm is most common.

As a hole is drilled, the dust that is produced must be removed from the hole in some manner. Early drilling systems either had augers to pull the dust out or merely allowed the dust to fall out of the hole. Later it was discovered that a vacuum could be put on the hole to draw the dust out between the drill steel and the sides of the hole. In modern drilling systems the dust is forced by a vacuum through dust ports into the interior of a hollow drill steel, and then out of the hole. U.S. Pat. No. 3,187,825 illustrates both interior and exterior vacuum dust collection systems.

The modern roof bit has a hard carbide insert which forms the cutting edge of the bit. As the roof of the mine is drilled, particles of dust are directed downward, toward the dust ports, by multiple work surfaces on the bit body. Many different combinations of work surfaces and dust ports have been tried in the attempt to maximize efficiency and minimize costs. For example, U.S. Pat. Nos. 3,434,553 and 3,434,554 show roof bits in which the dust ports are drilled in the dust control surfaces downwardly at an angle. In contrast, U.S. Pat. No. 4,313,506 discloses a roof bit in which the dust ports are positioned below the work surfaces.

BROAD DESCRIPTION OF THE INVENTION

The general object of this invention is to provide a roof bit which maximizes cutting efficiency, and minimizes production costs and steel plugging. In general this object is accomplished by the provision of a roof bit with multiple work surfaces which define parallel crown lines on each side of the cutter insert. Further, the roof bit has a pair of diametrically opposed dust ports which are drilled on an axis perpendicular to the longitudinal central axis of the bit body, and are located at least partly in the work surfaces.

This design maximizes cutting efficiency by creating a minimum of steel plugging which would interfere with the drilling process. The design also minimizes production costs by allowing the work surfaces to be straddle milled in a single pass and by allowing both dust ports to be drilled in a single pass.

Further, the design of the roof bit may be adjusted by moving the dust ports up or down on the work surfaces to vary the width of the dust port throat. This relatively easy design variation allows the bit manufacturer to provide the optimum throat width for the roof conditions, to maximize rate of penetration and minimize steel plugging.

The above, as well as additional objects, features and advantages of the invention will become apparent in the following detailed description.

DESCRIPTION OF THE PREFERRED EMBODIMENT

Figure 1:
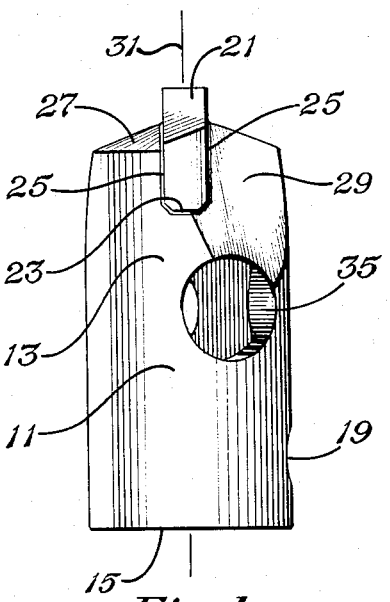
FIG. 1 is a side view of the cutter bit.
Figure 2:
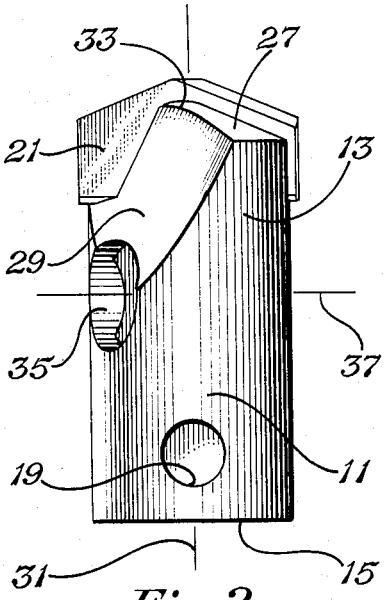
FIG. 2 is a side view of the cutter bit, at an angle of 90 degrees from the view in FIG. 1.
Figure 4:
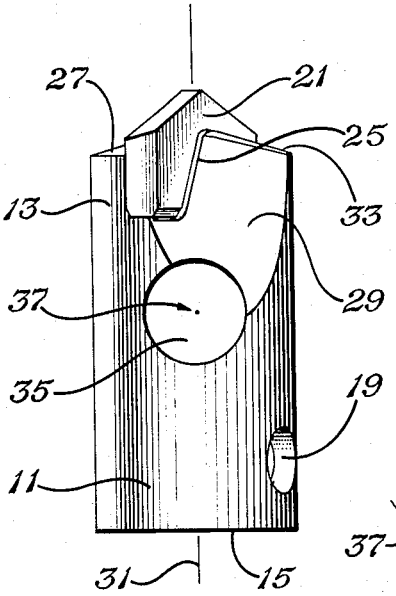
FIG. 4 is a side view of the cutter bit, at an angle of 35 degrees from the view in FIG. 1.
Figure 3:
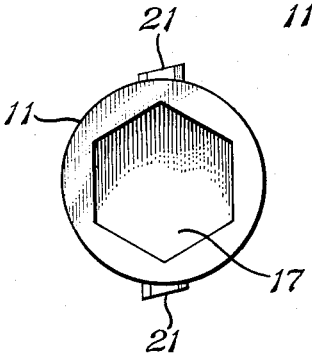
FIG. 3 is a bottom view of the cutter bit.
Figure 5:
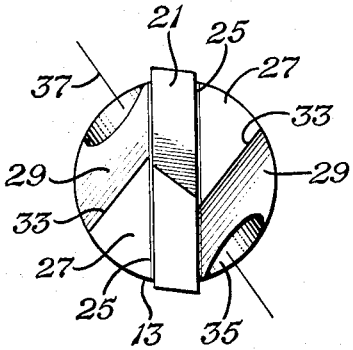
FIG. 5 is a top view of the cutter bit.

The preferred embodiment of the invention, as illustrated in the drawing, is a roof bit having a tubular body 11, having a closed upper end 13 and an open lower end 15. The interior of the bit body 11 is a hexagonal bore 17 which extends from the open lower end 15 to near the closed upper end 13 of the bit. The bit body 11 also has a small retention hole 19 near the open lower end 15 for securing the cutter bit to the drill steel (not shown).

At the upper end 13, the bit has a plate-like, hard carbide insert 21, mounted in a transverse groove 23. A flat braze shim 25 is placed on each side of the insert 21 and then the insert 21 is brazed to the steel of the bit body 11. The insert 21 may also be mounted by press fitting the insert 21 into the groove 23, with or without using malleable shims 25. The ends of the insert 21 extend slightly beyond the sides of the body 11 so that the hole will be slightly larger than the bit body 11.

The upper end 13 of the bit body 11 also has multiple work surfaces, including a pair of heel surfaces 27 and a pair of dust control surfaces 29. The heel surfaces 27 are disposed on opposite sides of the cutter insert 21 and taper downwardly and outwardly away from the longitudinal central axis 31 of the bit body 11. The dust control surfaces 29 are also oppositely disposed and taper downwardly and outwardly, but at a greater inclined angle than the heel surfaces 27. The intersection or junction between the heel surface 27 and dust control surface 29 on each side of the insert 21 defines a crown line 33 which intersects the groove 21 in an oblique fashion and runs downwardly from the insert 21. The crown lines 33 on each side of the insert 21 intersect the groove 21 at the same angle, so the crown lines 33 are parallel. This arrangement allows the cutter bit body 11 to be straddle-milled so that both dust control surfaces 29 are formed in a single pass.

Below the groove 23, the bit body 11 has a pair of dust ports, or openings 35, which extend into the bore 17 of the body 11. These openings 35 are located on diametically opposite sides of the bit body 11, and at least partly in the dust control surfaces 29. Both openings 35 are drilled on the same axis 37, which is transverse to the longitudinal central axis 31 of the bit body 11. This allows the two openings 35 to be drilled in a single pass, thus minimizing production costs.

In operation the cutter bit 11 is connected to a hollow, hexagonal drill steel (not shown) by inserting the drill steel into the lower end 15 of the bit. A button on the drill steel engages the retention hole 19 on the bit body 11 to secure the bit to the drill steel. As the drill steel rotates the bit, the carbide insert 21 cuts a hole in the mine roof. A vacuum draws the dust and other cuttings across the dust control surfaces 29, through the dust ports 35, through the bore 17 of the bit body 11, and then out of the hole by way of the drill steel.

While the invention has been shown in only one of its forms, it should be apparent to those skilled in the art that it is not so limited, but is susceptible to various changes and modifications without departing from the spirit thereof.

I claim:

1. A cutter bit for roof drilling, comprising:

a cylindrically shaped tubular body having a cylindrical exterior, a solid upper end and an open lower end, the solid upper end being of the same outside diameter as the lower end of the cylindrically-shaped body;

the body having an upwardly opening groove formed transversely of the upper end of the body;

a plate-like, hard carbide insert fixed within the groove and extending outwardly thereform to form a cutting edge;

the upper end of the body having multiple work surfaces including a pair of oppositely disposed, tapered heel surfaces extending downwardly and outwardly in a direction away from the longitudinal central axis of the body and a pair of oppositely disposed, tapered dust control surfaces, the dust control surfaces being disposed on an inclined angle greater than that of the heel surfaces; and the body having a pair of openings formed beneath the groove and extending inwardly in open communication with the hollow interior of the body, the openings being formed diametrically opposite each other on an axis transverse to the longitudinal central axis of the body, and at least partly on the tapered dust control surfaces, and wherein the remaining portion of each of said openings is located on the outside diameter of said cylindrically-shaped body.

2. A cutter bit for roof drilling having improved features for removing drilling cuttings, comprising:

a cylindrically shaped tubular body having a cylindrical exterior, a solid upper end and an open lower end, the solid upper end being of the same outside diameter as the lower end of the cylindrically-shaped body;

the body having an upwardly opening groove formed transversely of the upper end of the body;

a plate-like, hard carbide insert fixed within the groove and extending outwardly thereform to form a cutting edge;

the upper end of the body having multiple work surfaces including a pair of oppositely disposed, tapered heel surfaces extending downwardly and outwardly in a direction away from the longitudinal central axis of the body and a pair of oppositely disposed, tapered dust control surfaces, the dust control surfaces being disposed on an inclined angle greater than that of the heel surfaces and forming a plane which intersects the cylindrical exterior of the body;

the body having a pair of openings formed beneath the groove and extending inwardly in open communication with the hollow interior of the body, the openings being formed diametrically opposite each other on an axis transverse to the longitudinal central axis of the body, and at least partly on the tapered dust control surfaces, and wherein the plane of each dust control surface which intersects the cylindrical exterior of the body intersects less than fifty percent of the nearest transverse opening, and wherein the remaining portion of each of said openings is located on the outside diameter of said cylindrically-shaped body.

* * * * *